US009007160B2

(12) United States Patent
Yokoyama et al.

(10) Patent No.: US 9,007,160 B2
(45) Date of Patent: Apr. 14, 2015

(54) LAMINATED INDUCTOR

(71) Applicant: Taiyo Yuden Co., Ltd., Taito-ku, Tokyo (JP)

(72) Inventors: Ichirou Yokoyama, Gunma (JP); Taisuke Suzuki, Gunma (JP); Yasuyuki Taki, Gunma (JP); Kazuhiko Oyama, Gunma (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 0 days.

(21) Appl. No.: 13/754,759

(22) Filed: Jan. 30, 2013

(65) Prior Publication Data

US 2013/0200979 A1 Aug. 8, 2013

(30) Foreign Application Priority Data

Feb. 8, 2012 (JP) ..... 2012-025607

(51) Int. Cl.
*H01F 5/00* (2006.01)
*H01F 27/28* (2006.01)
(Continued)

(52) U.S. Cl.
CPC ..... *H01F 17/0013* (2013.01)

(58) Field of Classification Search
CPC . H01F 27/2804; H01F 17/0013; H01F 5/003; H01F 41/046; H01F 41/041
USPC ..... 336/200, 223, 232, 234
See application file for complete search history.

(56) References Cited

U.S. PATENT DOCUMENTS 4,918,570 A * 4/1990 Okamura et al. ..... 361/321.2
5,359,304 A * 10/1994 Fujiki ..... 333/116
7,173,508 B2 * 2/2007 Anbo et al. ..... 336/200
(Continued)

FOREIGN PATENT DOCUMENTS

JP H11-097244 A 4/1999
JP H11-273950 A 10/1999
(Continued)

OTHER PUBLICATIONS

A Notification of Reasons for Refusal issued by the Japanese Patent Office, mailed Apr. 21, 2014, for Japanese counterpart application No. 2012-025607.
(Continued)

*Primary Examiner* — Elvin G Enad
*Assistant Examiner* — Kazi Hossain
(74) *Attorney, Agent, or Firm* — Law Office of Katsuhiro Arai

(57) ABSTRACT

A laminated inductor includes a laminate constituted by multiple insulator layers, and a coil conductor formed in a spiral shape inside the laminate; wherein the coil conductor has conductor patterns formed on the insulator layers, and via hole conductors that penetrate through the insulator layers and electrically connect the multiple conductor patterns; wherein conductor patterns formed on some insulator layers each represent a C-shaped pattern that includes the four corners and has an open part on one side, of a roughly rectangular shape, while a conductor pattern formed on other insulator layer(s) represents a line-shaped pattern corresponding to the open part of one side of the aforementioned C-shaped pattern of the roughly rectangular shape; and wherein an insulator layer on which the C-shaped pattern is formed, and insulator layer(s) on which the line-shaped pattern is formed, adjoin each other at least in one part of the laminate.

4 Claims, 4 Drawing Sheets

(51) Int. Cl.
*H01F 27/24* (2006.01)
*H01F 17/00* (2006.01)

(56) References Cited

U.S. PATENT DOCUMENTS

| | | | | |
|---|---|---|---|---|
| 8,093,981 | B2 * | 1/2012 | Chung | 336/200 |
| 2003/0117230 | A1 * | 6/2003 | Shin | 333/116 |
| 2008/0012679 | A1 * | 1/2008 | Okabe et al. | 336/200 |
| 2008/0257488 | A1 * | 10/2008 | Yamano | 156/272.4 |
| 2011/0133881 | A1 * | 6/2011 | Nakajima et al. | 336/200 |

FOREIGN PATENT DOCUMENTS

| | | | |
|---|---|---|---|
| JP | H11-340042 | A | 12/1999 |
| JP | 2000-341070 | A | 12/2000 |
| JP | 2003-272921 | A | 9/2003 |
| JP | 2005-051432 | A | 2/2005 |

OTHER PUBLICATIONS

An Office Action issued by the Korean Patent Office, mailed May 20, 2014, for Korean counterpart application No. 10-2013-0004331.

An Office Action issued by the Korean Patent Office, mailed Nov. 26, 2013, for Korean counterpart application No. 10-2013-0004331.

A Notification of Reasons for Refusal issued by the Japanese Patent Office, mailed Dec. 17, 2013, for Japanese counterpart application No. 2013-025607.

* cited by examiner

LAMINATED INDUCTOR

BACKGROUND

1. Field of the Invention

The present invention relates to a laminated inductor.

2. Description of the Related Art

As electronic devices become smaller and support multiple bandwidths in recent years, the market is demanding laminated inductors that are smaller, higher in Q, and offering narrower inductance steps and smaller induction deviation. With conventional laminated inductors, the coil is formed by combining multiple conductor patterns obtained from multiple screen masks, or combining multiple conductor patterns obtained by shifting identical screen masks. FIG. 4 is a schematic exploded view showing an example of a laminated inductor based on prior art, where conductor patterns B21 to B26 of specified shapes are formed on insulator layers A22 to A27 and these conductor patterns are electrically connected through via hole conductors C21 to C25, to constitute a laminated inductor having a spirally formed coil conductor. Here, the lamination position of each pattern may shift depending on the accuracy of screen mask and mechanical accuracy, which can change the core area of the coil and consequently cause the inductor L-value to offset from the center or to vary.

The invention disclosed in Patent Literature 1 is a laminated inductor characterized in that the core area formed by a part of the coil conductor is smaller than the minimum core area formed by the remainder of the coil conductor. This way, according to the aforementioned patent literature, any variation in L-value caused by lamination shift of conductor patterns will depend on the number of turns of the coil conductor of the smaller core area and, by considering that the conductor pattern forming the coil conductor of the smaller core area occupies only a part of the overall conductor pattern, a small laminated inductor subject to less variation in L-value and offering large allowable current can be provided.

BACKGROUND ART LITERATURES

[Patent Literature 1] Japanese Patent Laid-open No. Hei 11-340042

SUMMARY

According to the configuration of Patent Literature 1, how much the formed core area can be reduced is limited and therefore providing a small inductor becomes difficult. An object of the present invention is to provide a laminated inductor subject to less change in core area and less variation in L-value.

After studying in earnest, the inventors completed the present invention, the details of which are described below.

The laminated inductor proposed by the present invention comprises a laminate constituted by multiple insulator layers, and a coil conductor formed in a spiral shape inside the laminate. The coil conductor has conductor patterns formed on the insulator layers, and via hole conductors that penetrate through the insulator layers and electrically connect the multiple conductor patterns. Conductor patterns formed on some insulator layers each represent a C-shaped pattern that includes the four corners and has an open part on one side, of a roughly rectangular shape. A conductor pattern formed on other insulator layer(s) represents a line-shaped pattern (or a lower case letter "1"-shaped pattern) corresponding to the open part of one side of the aforementioned C-shaped pattern of the roughly rectangular shape. Insulator layers on which the C-shaped pattern is formed, and the insulator layer(s) on which the line-shaped pattern is formed, adjoin each other at least in one part of the laminate.

Preferably external electrodes are formed on the outside of the laminate constituted by the insulator layers, the coil conductor has leaders that electrically connect to the external electrodes and a coil body other than the leaders, and the conductor patterns constituting the coil body are based only on a combination of the C-shaped pattern and line-shaped pattern. Also, preferably the length of the line-shaped pattern is equal to or less than 30% of the total lengths of the four sides (along the center line) of the roughly rectangular shape constituting the C-shaped pattern.

According to the present invention, an inductor subject to less change in core area and less variation in L-value can be obtained. To be specific, because the C-shaped pattern virtually determines the area specified by the coil conductor of roughly rectangular shape, any change in area caused by shifting of conductor patterns formed on multiple insulator layers is minimized, and this in turn minimizes variation in L-value. The present invention can be applied even when the roughly rectangular shape has a small area, which means that it can also help reduce the size of a laminated inductor subject to less variation in L-value.

Any discussion of problems and solutions involved in the related art has been included in this disclosure solely for the purposes of providing a context for the present invention, and should not be taken as an admission that any or all of the discussion were known at the time the invention was made.

For purposes of summarizing aspects of the invention and the advantages achieved over the related art, certain objects and advantages of the invention are described in this disclosure. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description which follows.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

DESCRIPTION OF THE SYMBOLS

Figure 1:
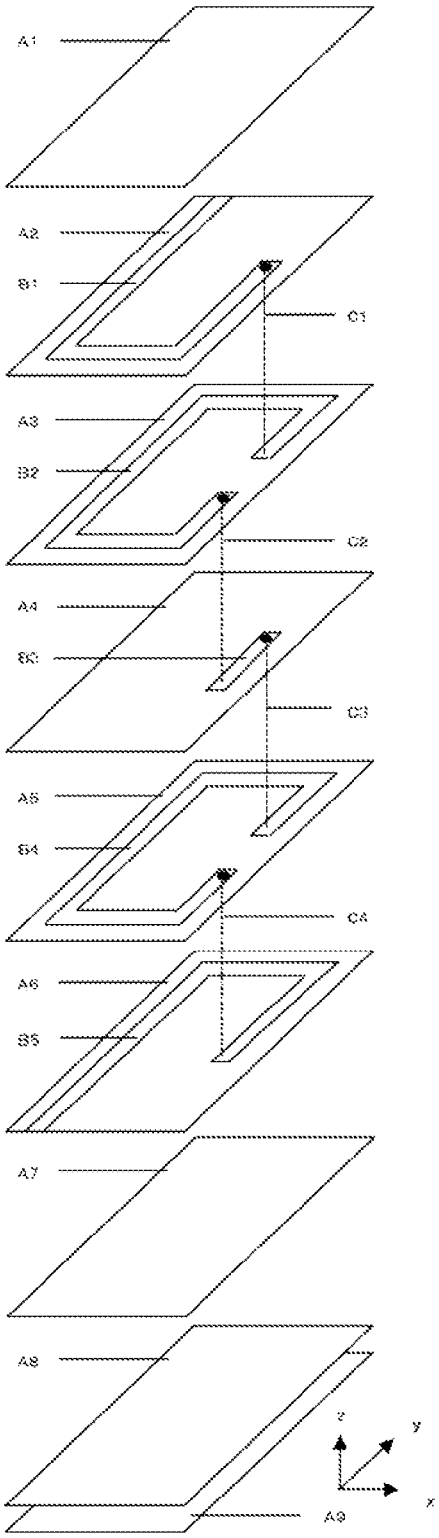
FIG. 1 is a schematic exploded view of an example of a laminated inductor conforming to the present invention.

10 Laminated inductor
A1 to A9 Insulator layer
B1 to B5 Conductor pattern
C1 to C4 Via hole conductor
D1, D2 External electrode

DETAILED DESCRIPTION OF EMBODIMENTS

The present invention is described below by referring to the drawings as deemed appropriate. It should be noted, however, that the present invention is not at all limited to the illustrated embodiments and that the scale of each part of the drawings is not necessarily accurate because characteristic parts of the present invention may be emphasized in the drawings.

The laminated inductor proposed by the present invention comprises a laminate constituted by multiple insulator layers, and a coil conductor formed in a spiral shape inside the laminate. FIG. 1 is a schematic exploded view of an example of a laminated inductor conforming to the present invention. Conductor patterns B1 to B5 are formed on insulator layers A2 to A6. The conductor patterns formed on different insulator layers are electrically interconnected through via hole conductors C1 to C4, and these via hole conductors C1 to C4 each penetrate through at least one insulator layer. In the figure, the via hole conductors penetrate through the insulator layers at the locations indicated by black circles. The conductor patterns B1 to B5 and via hole conductors C1 to C4 constitute a spirally formed coil conductor.

Figure 2:
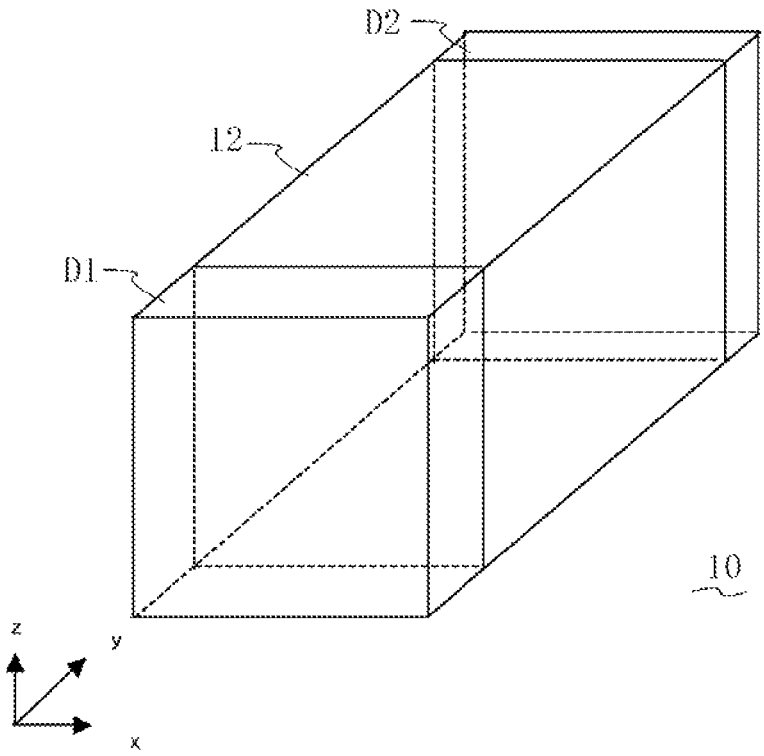
FIG. 2 is a schematic perspective view of an example of a laminated inductor conforming to the present invention.

FIG. 2 is a schematic perspective view of an example of a laminated inductor conforming to the present invention. External electrodes D1, D2 are formed at both ends of the aforementioned laminate 12 constituted by multiple insulator layers. The conductor patterns B1 and B5 in FIG. 1 (not illustrated in FIG. 2) reach the ends of the laminate constituted by insulator layers and electrically connect to the external electrodes Dl, D2 shown in FIG. 1, respectively. In the present invention, these conductor patterns provided to electrically connect to the external electrodes are referred to as "leaders." The conductor patterns other than the leaders and via hole conductors are collectively referred to as "coil body." In the embodiment shown in FIG. 1, the conductor patterns B2 to B4 and via hole conductors C2 and C3 constitute the coil body.

According to the present invention, as described later, insulator layers on which the C-shaped pattern is formed, and insulator layer(s) on which the line-shaped pattern is formed, adjoin each other at least in one part of the laminate. Preferably the coil body is constituted only by a combination of the C-shaped pattern and line-shaped pattern.

The C-shaped pattern represents a conductor pattern that includes the four corners of a roughly rectangular shape and has an open part on one side of the roughly rectangular shape. According to the embodiment in FIG. 1, the C-shaped pattern is indicated by the reference numerals B2 and B4. The roughly rectangular shape may be a rectangle as shown in FIG. 1, or oval or other shape that approximates a rectangle. "The C-shaped pattern . . . includes the four corners of a roughly rectangular shape" encompasses a case where the pattern includes the four corners as shown in FIG. 1, as well as a case where the pattern includes locations that are recognized as corners of an approximate rectangle when the roughly rectangular shape does not have clear corners. The C-shaped pattern has an open part on one side of the roughly rectangular shape. As such, the C-shaped pattern specifies a majority of the core area.

The line-shaped pattern corresponds to the open part of one side of the C-shaped pattern of roughly rectangular shape. According to the embodiment in FIG. 1, the line-shaped pattern is indicated by the reference numeral B3. The line-shaped pattern may be a straight line as shown in FIG. 1, or curved line constituting a part of an oval shape, in accordance with the actual shape of the roughly rectangular shape. The length of the line-shaped pattern is preferably equal to or less than 30%, and more preferably between 10 and 20%, of the total length of the four sides of the roughly rectangular shape constituting the C-shaped pattern. In other words, preferably the length of the line-shaped pattern is equal to or less than three-sevenths of the length of the C-shaped pattern. The length of the line-shaped pattern may be increased above the length of the open part in the C-shaped pattern for the purpose of greater reliability of electrical connection, as long as the effects of the present invention are not negatively affected.

According to the present invention, insulator layers on which a C-shaped pattern is formed, and insulator layer(s) on which a line-shaped pattern is formed, adjoin each other in at least one location. This way, a single-turn coil of roughly rectangular shape is constituted. Here, because the core area is fixed primarily by the C-shaped pattern, the accuracy of the core area depends in large part on the formation accuracy of the C-shaped pattern (printing accuracy, etc.) and therefore the accuracy of the core area is hardly affected by the accuracy of other adjoining patterns, position accuracy at the time of lamination, and the like. With the laminated inductor 10 conforming to the present invention, change in inductance can be reduced. In general, the inductance L is proportional to (S/I), where I represents the coil length and S represents the core area. Accordingly, the laminated inductor 10 subject to less variation in core area S is also subject to less change in inductance. This makes it easier to improve the accuracy of the core area of the laminated inductor as a whole, resulting in less variation in inductance.

According to the embodiment in FIG. 1, one C-shaped pattern and one line-shaped pattern (1-shaped pattern) constitute a single-turn coil conductor, and one more C-shaped pattern is provided. This embodiment is denoted as "C-l-C." According to the present invention, C-shaped pattern layers and line-shaped pattern layers may be laminated in such a way that each pattern is adjoined by the other pattern in the sequence of C-l-C-l- . . . , etc., or in such a way that a multiple number of at least one pattern is adjoined by the other pattern in the sequence of C-C-l-C-Cl- . . . or C-l-l-C-1-l- . . . , etc., for example.

According to the present invention, the coil body of the coil conductor only needs to have a lamination structure where there is at least one set of C-l layers adjoining each other, and U-shaped patterns may be laminated partially to adjust the inductor value, for example. According to a favorable embodiment, the coil body of the coil conductor is entirely constituted by a combination of the C-shaped pattern and line-shaped pattern.

A more specific embodiment is explained below, but it should be noted that this explanation does not limit the present invention in any way. Here, the lamination direction of the laminated inductor 10 is defined as the z-axis direction, direction along the short side of the laminated inductor 10 is defined as the x-axis direction, and direction along the long side of the laminated inductor 10 is defined as the y-axis direction. The x-axis, y-axis and z-axis intersect one another at right angles. The laminated inductor 10 has a laminate 12 and external electrodes D1, D2. The external electrodes D1, D2 electrically connect to the coil conductor, respectively, extend in the z-axis direction, and are provided on the opposing side faces of the laminate 12. Under this embodiment, the external electrodes D1, D2 are provided in a manner covering the two side faces positioned at both ends in the y-axis direction. The laminate 12 is constituted by insulator layers A1 to A9 laminated in the z-axis direction. Under this embodiment, the insulator layers A1 to A9 are made with a material whose main ingredient is glass, and have a rectangular shape. The coil conductor has a spiral shape that extends in the z-axis direction while turning, and includes conductor patterns B1 to B5 and via hole conductors C1 to C4. The conductor patterns B1 to B5 are formed on the main sides of the insulator layers A2 to A6, respectively, and laminated together with the insulator layers A1 and A7 to A9. Each conductor pattern is made with a conductive material such as Ag. The conductor patterns B1 and B5 are leaders. The conductor pattern B1 and coil conductor B5 connect to the external electrodes D1, D2, respectively. The conductor patterns B2, B5 are interconnected via the conductor pattern B3. Interconnection of the conductor patterns B1, B2 and conductor patterns B4, B5 connects the external electrodes D1, D2 electrically. The conductor patterns are connected through the via hole conductors C1 to C4, respectively.

Here, for the insulator layers, ferrite, dielectric ceramics, magnetic material using soft magnetic alloy particles, or resin into which magnetic powder is mixed, and the like can be used, in addition to the material whose main ingredient is glass.

A typical manufacturing method of such laminated inductor is illustrated. It should be noted that the present invention is not limited to this manufacturing method in any way. Multiple insulating green sheets are provided as precursors to the insulator layers A1 to A9. The green sheets are formed by coating a film with an insulating slurry whose main ingredient is glass, etc., using the doctor blade method, etc. The thickness of the green sheets is not limited in any way, and is preferably 5 to 30 μm, such as 18 μm. Through holes are formed by laser processing, etc., at the specified positions on the insulating green sheets which will become the insulator layers A2 to A5, or specifically the positions where the via hole conductors C1 to C4 will be formed. Then, a conductive paste being a precursor to the conductor patterns B1 to B5 is printed, by means of screen mask, etc., at the specified positions on the insulating green sheet which will become the insulator layers A2 to A6. The main ingredient of the conductive paste may be metal such as silver, copper or the like.

Next, insulating green sheets which will become the insulator layers Al to A9 are laminated in the order shown in FIG. 1, after which pressure is applied in the direction in which they are laminated, to pressure-bond the insulating green sheets. Thereafter, the pressure-bonded insulating green sheets are cut to individual chips, which are then sintered at a specified temperature (such as 800 to 900° C. or so) to form a laminate 12. Next, external electrodes D1, D2 are formed on this laminate 12. An electronic component 10 is thus formed. The external electrodes D1, D2 are formed by coating both end faces of the laminate 12 in the lengthwise direction with an electrode paste whose main ingredient is silver, copper, etc., followed by baking at the specified temperature (such as 680 to 900° C. or so) and electroplating. For this electroplating, Cu, Ni, Sn, etc., can be used. The laminated inductor 10 is completed through the aforementioned steps.

EXAMPLE

The results of computer simulations conducted to present the effects of the present invention more clearly, are explained below. To be specific, the first model (Example) contains its coil body constituted by a C-shaped pattern and line-shaped pattern. Here, the length of the line-shaped pattern is 14% of one turn. The second model (Comparative Example) is structured in such a way that coil conductors, each of one-half a turn, are connected together. The first model and second model both have a size of 0.6 mm×0.3 mm×0.3 mm, where the coil conductor is a silver electrode of 50 μm in line width and 8 μm in thickness.

Figure 3:
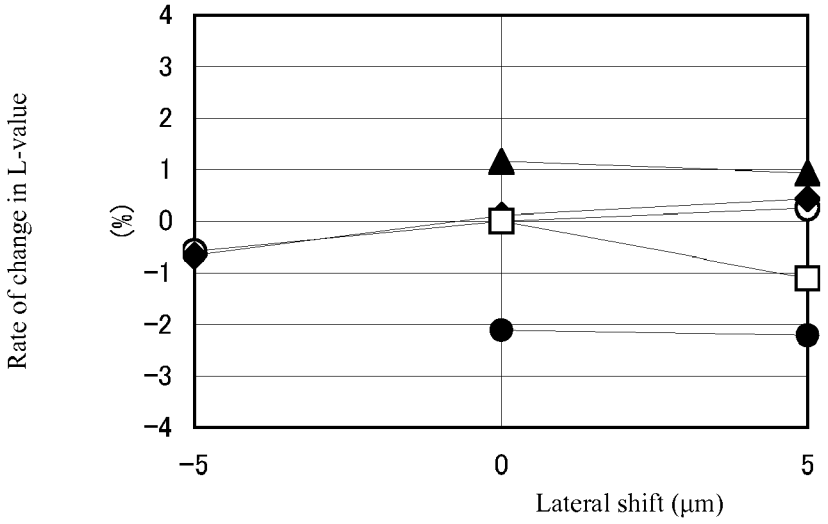
FIG. 3 is a graph showing computer simulation results.
Figure 4:
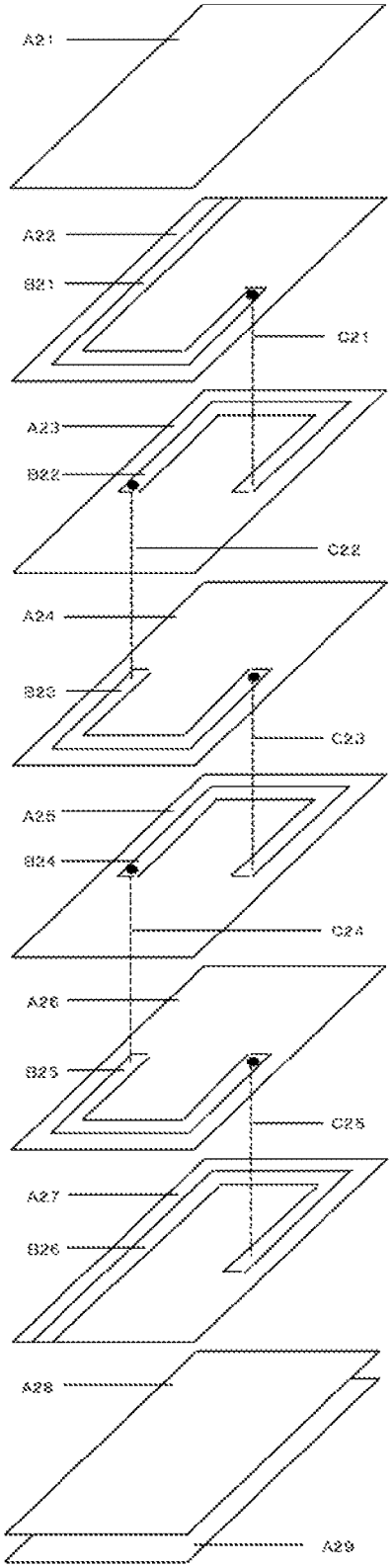
Fig. 4 (Background Art)
FIG. 4 is a schematic exploded view of an example of a conventional laminated inductor.

In this computer simulation, inductance was calculated on the first and second models at an input signal frequency of 500 MHz under different conditions: on the first model as is; after shifting the position of the line-shaped pattern of the coil conductor of the first model by ±5 μm in the x direction and by +5 μm in the y direction; on the second model as is; and after shifting one coil conductor of the second model by +5 μm in the x direction and ±5 μm in the y direction. The results are shown in FIG. 3. In this graph, the ○ plot represents measurements taken on the first model without shifting it, ♦ plot represents measurements taken on the first model after shifting it by +5 μm in the y direction, □ plot represents measurements taken on the second model without shifting it, ▲ plot represents measurements taken on the second model after shifting it by +5 μm in the y direction, and ● plot represents measurements taken on the second model after shifting it by −5 μm in the y direction.

With the first model (Example), the maximum change in inductance when a signal of 500 MHz in frequency was input was 0.7%. With the second model (Comparative Example), on the other hand, the maximum change in inductance when a signal of 500 MHz in frequency was input was 2.2%. Clearly, Example resulted in less change in inductance. In other words, these simulations show that a laminated inductor having a structure of a C-shaped pattern and line-shaped pattern adjoining each other is subject to less change in inductance.

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. Further, in this disclosure, an article "a" or "an" may refer to a species or a genus including multiple species, and "the invention" or "the present invention" may refer to at least one of the embodiments or aspects explicitly, necessarily, or inherently disclosed herein. In this disclosure, any defined meanings do not necessarily exclude ordinary and customary meanings in some embodiments.

The present application claims priority to Japanese Patent Application No. 2012-025607, filed Feb. 8, 2012, the disclosure of which is incorporated herein by reference in its entirety.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. A laminated inductor comprising a laminate constituted by multiple insulator layers, and a coil conductor formed in a spiral shape inside the laminate;

wherein the coil conductor has conductor patterns formed on the insulator layers, and via hole conductors that penetrate through the insulator layers and which electrically connect the multiple conductor patterns;

wherein a first conductor pattern formed on an insulator layer among the insulator layers consists of a C-shaped pattern that includes four corners and has an open part on one side, of a roughly rectangular shape, while a second conductor pattern formed as the only conductor pattern on another insulator layer among the insulator layers consists of a straight line-shaped pattern disposed to close the open part of one side of the C-shaped pattern of the roughly rectangular shape as viewed from above when the insulation layer with the first conductor pattern and the insulation layer with the second conductor pattern are stacked;

wherein the insulator layer with the first conductor pattern and the insulator layer with the second conductor pattern are alternately stacked multiple times at least in one part of the laminate, wherein the first and second conductor patterns are electrically connected via hole conductors; and wherein the open parts of all of the C-shaped patterns on the insulator layers face the same side of the laminate as viewed from above.

2. A laminated inductor according to claim 1, wherein the laminated inductor has external electrodes formed outside the laminate, while the coil conductor has (i) leaders that electrically connect to the external electrodes and (ii) a coil body other than the leaders, and the conductor patterns of the coil body consist of the C-shaped pattern and straight line-shaped pattern.

3. A laminated inductor according to claim 1, wherein a length of the straight line-shaped pattern is equal to or less than 30% of a total length of the four sides of the roughly rectangular shape constituting the C-shaped pattern.

4. A laminated inductor according to claim 2, wherein a length of the straight line-shaped pattern is equal to or less than 30% of a total length of the four sides of the roughly rectangular shape constituting the C-shaped pattern.

* * * * *